US011241608B2

(12) United States Patent
Penn

(10) Patent No.: US 11,241,608 B2
(45) Date of Patent: Feb. 8, 2022

(54) SYSTEMS AND METHODS FOR VOLLEYBALL SCOREKEEPING

(71) Applicant: Morris Green Penn, West Chester, OH (US)

(72) Inventor: Morris Green Penn, West Chester, OH (US)

( * ) Notice: Subject to any disclaimer, the term of this patent is extended or adjusted under 35 U.S.C. 154(b) by 0 days.

(21) Appl. No.: 16/483,916

(22) PCT Filed: Feb. 8, 2018

(86) PCT No.: PCT/US2018/017448
§ 371 (c)(1),
(2) Date: Aug. 6, 2019

(87) PCT Pub. No.: WO2018/148428
PCT Pub. Date: Aug. 16, 2018

(65) Prior Publication Data

US 2019/0381385 A1 Dec. 19, 2019

Related U.S. Application Data

(60) Provisional application No. 62/471,753, filed on Mar. 15, 2017, provisional application No. 62/457,409, filed on Feb. 10, 2017.

(51) Int. Cl.
*A63B 71/06* (2006.01)
*A63B 61/00* (2006.01)
(Continued)

(52) U.S. Cl.
CPC ..... *A63B 71/0672* (2013.01); *A63B 61/003* (2013.01); *A63B 71/023* (2013.01);
(Continued)

(58) Field of Classification Search
CPC ..... A63B 71/0672; A63B 61/003; A63B 2102/02; A63B 2243/0095;
(Continued)

(56) References Cited

U.S. PATENT DOCUMENTS 4,185,583 A 1/1980 Stamm
4,210,093 A 7/1980 Baker
(Continued)

FOREIGN PATENT DOCUMENTS

WO 1994012965 A1 6/1994

OTHER PUBLICATIONS

International Search Report and Written Opinion of the International Searching Authority for Application No. PCT/US2018/017448 dated May 25, 2018 (10 pages).
(Continued)

*Primary Examiner* — Jeffrey S Vanderveen
(74) *Attorney, Agent, or Firm* — Ulmer & Berne LLP

(57) ABSTRACT

The scorekeeping system includes a plurality of scoring elements. An upper bracket can be secured a first string having a first portion of the plurality scoring elements and a second string having a second portion of the plurality of scoring elements. The first string can have a first thread and a second thread, each of the first thread and the second thread being threaded through the first portion of the plurality of the scoring elements. The second string can have a third thread and a fourth thread, each of the third thread and fourth thread being threaded through the second portion of the plurality of the scoring elements.

10 Claims, 15 Drawing Sheets

(51) Int. Cl.
*A63B 102/02* (2015.01)
*A63B 102/04* (2015.01)
*A63B 71/02* (2006.01)

(52) U.S. Cl.
CPC ... *A63B 2071/0694* (2013.01); *A63B 2102/02* (2015.10); *A63B 2102/04* (2015.10); *A63B 2210/50* (2013.01); *A63B 2225/093* (2013.01); *A63B 2225/74* (2020.08); *A63B 2243/0095* (2013.01)

(58) Field of Classification Search
CPC ..... A63B 2207/02; A63B 2225/093; A63B 2071/0694; A63B 71/023; A63B 2210/50; A63B 2102/04
See application file for complete search history.

(56) References Cited

U.S. PATENT DOCUMENTS

| | | | | |
|---|---|---|---|---|
| 4,912,307 | A * | 3/1990 | Shade | G06C 1/00 116/324 |
| 5,353,439 | A | 10/1994 | Kurtz et al. | |
| 2012/0285204 | A1* | 11/2012 | Coleman | D04B 3/00 66/1 A |

OTHER PUBLICATIONS

International Preliminary Report on Patentability and Written Opinion of the International Searching Authority in Application No. PCT/US2018/017448 dated Aug. 13, 2019; 8 pages.

* cited by examiner

SYSTEMS AND METHODS FOR VOLLEYBALL SCOREKEEPING

REFERENCE TO RELATED APPLICATION

The present application is a U.S. non-provisional application that claims the priority benefit of U.S. provisional patent application Ser. No. 62/457,409, filed Feb. 10, 2017, and hereby incorporates the same application by reference in its entirety. The present application is a U.S. non-provisional application that claims the priority benefit of U.S. provisional patent application Ser. No. 62/471,753, filed Mar. 15, 2017, and hereby incorporates the same application by reference in its entirety.

TECHNICAL FIELD

Embodiments of the technology relate, in general, to scorekeeping technology, and in particular to scorekeeping technology useful in competitive sports such as volleyball.

BACKGROUND

Certain sports, such as volleyball, can have relatively confusing scoring systems. While playing such sports the players of the teams involved can become distracted and have differing opinions as to the correct score. In the absence of a neutral scorekeeper tasked with keeping an accurate score the teams involved are left to scoring on their own, often by keeping score mentally. A better way to keep score in competitive sports would be beneficial to the players involved.

BRIEF DESCRIPTION OF THE DRAWINGS

The present disclosure will be more readily understood from a detailed description of some example embodiments taken in conjunction with the following figures.

DETAILED DESCRIPTION

Figure 1:
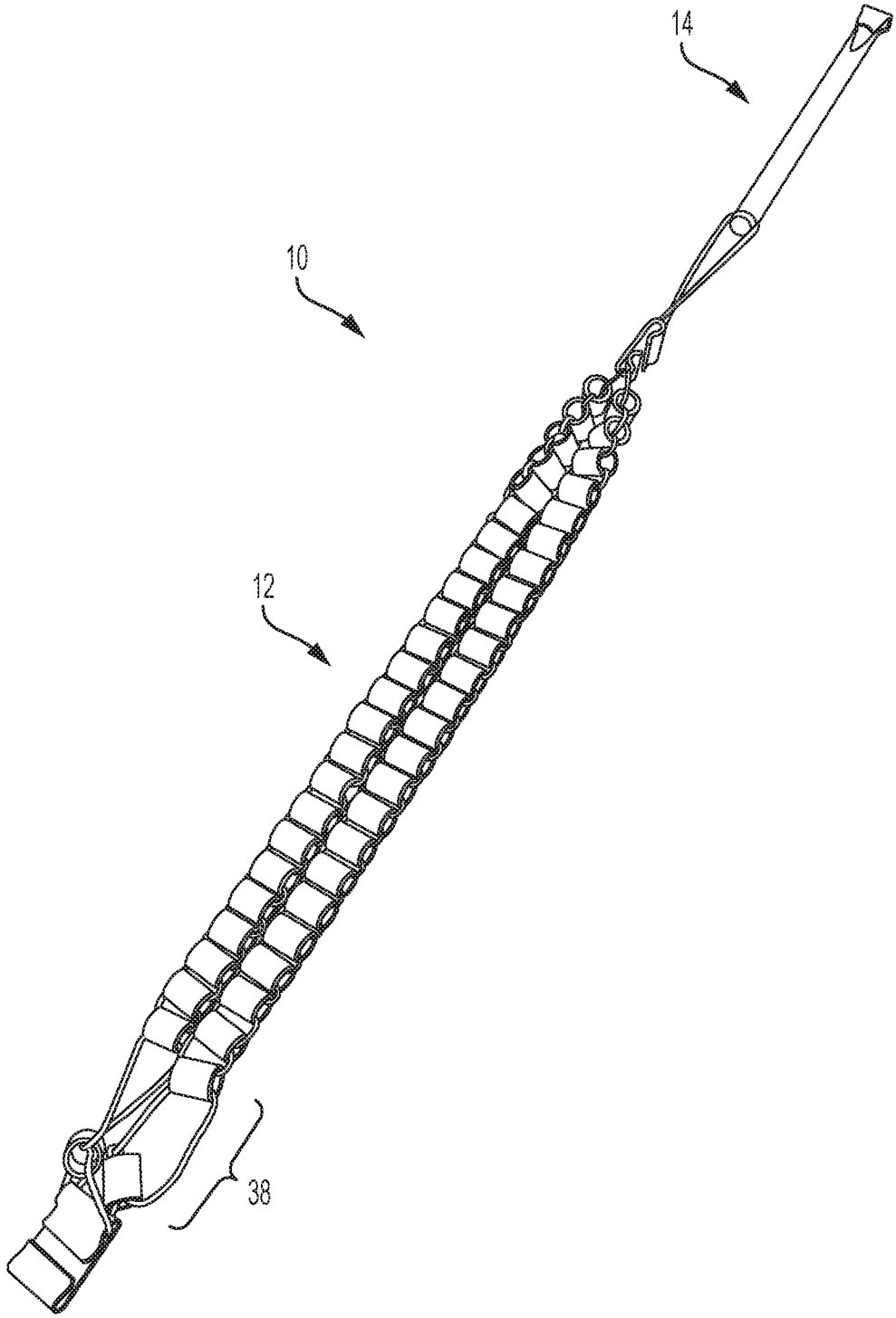
FIG. 1 is a perspective view of a volleyball scorekeeping system having a scoring assembly, the scoring assembly including top and bottom brackets, and an attached adapter according to one embodiment.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for scorekeeping. In one example embodiment, a volleyball scorekeeping system can be easily selectively detachable to a standard volleyball net for easy access and visibility. In some embodiments, a volleyball scorekeeping system can be provided that is easily transportable in a gym bag or the like for use at unfamiliar locations or gyms. In some embodiments, a volleyball scorekeeping system can include cylinders or beads that are easily moveable yet are resistant to movement when contacted by balls or other incidental contact. Embodiments of the volleyball scorekeeping system can be reversible such that, after completion of a game, the scoring assembly can simply be reversed to start a new game. Some embodiments of the volleyball scorekeeping system can include an adapter for attachment of the scoring assembly to a variety of standard volleyball net configurations.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can improve the accuracy of scorekeeping for sports such as volleyball where it can be difficult to keep accurate track of the score during a long series of games or matches. For example, a volleyball scoring system can easily be transported in a gym bag and attached to a wide variety of nets for use in nearly any location. Additionally, or alternatively, the volleyball system can be reversible and can have a plurality of beads or cylinders that are easily movable to keep score, but resistant to movement resulting from incidental contact.

Although described generally in terms of mechanical components, it will be appreciated that embodiments of the volleyball scorekeeping system can include a computer system that can be accessed via any suitable technique. In some embodiments, the systems and methods described herein can be a web-based application or a stand-alone executable. Additionally, in some embodiments, the systems and methods described herein can integrate with various types of recordkeeping systems, such as tournament or league systems, and the like. Any suitable client device can be used to access, or execute, a computing system associated with the scorekeeping device, such as laptop computers, desktop computers, smart phones, tablet computers, gaming system, and the like.

Systems and methods described herein may generally provide a digital scorekeeping environment for users (e.g., an LED or LCD display) to provide an easy scorekeeping reference. Interaction with the digital scorekeeping display or features may include, without limitation, keyboard entry, writing from pen, stylus, finger, or the like, with a computer mouse, or other forms of input (voice recognition, etc.). The display may be presented on a tablet, desktop, phone, board, or paper. In one embodiment, the user may interact with a score display by writing with a smart pen on normal paper, modified paper, or a hard flat surface of their preference. In this embodiment, the user may receive real-time feedback, or at least near real-time feedback, or may synchronize with a recordkeeping computer system at a later date. The display can be associated with a controller that can automatically determine when a bead or cylinder has been adjusted such that the score can be presented to the players visually via both the beads and the digital display. Alternatively, scoring can be kept manually with the beads or cylinders and then can be input into the digital display at the end of the game or match for record keeping, transmission to a recordkeeping body, or for any other suitable purpose.

Figure 8A:
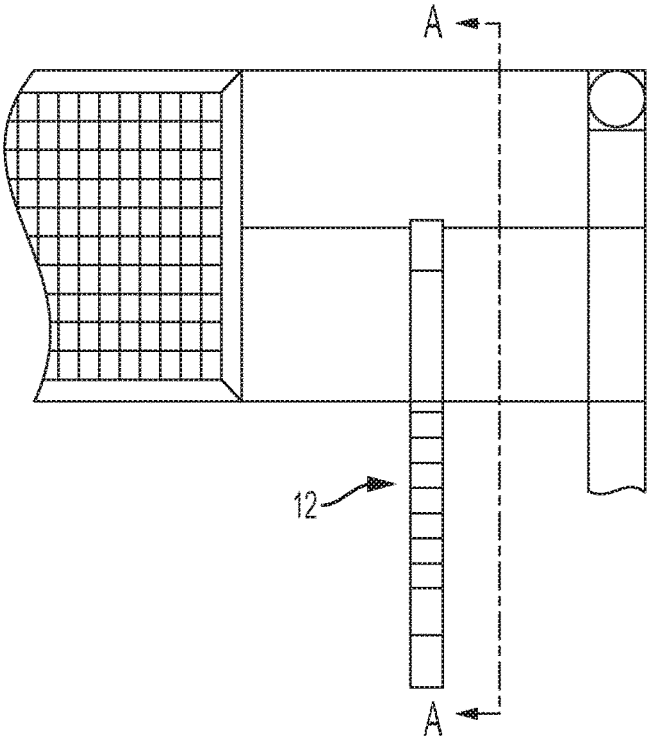
FIG. 8A depicts a front view of the scoring system of FIG. 2 shown engaged with a standard volleyball net having three supporting ropes or wires.
Figure 8B:
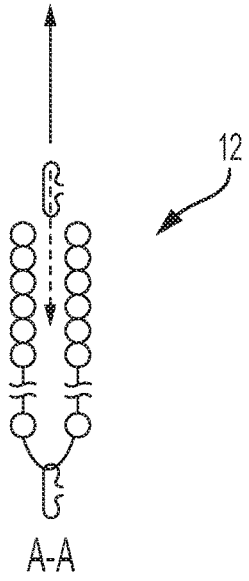
FIG. 8B depicts a side view of the scoring system shown in FIG. 8A.
Figure 9:
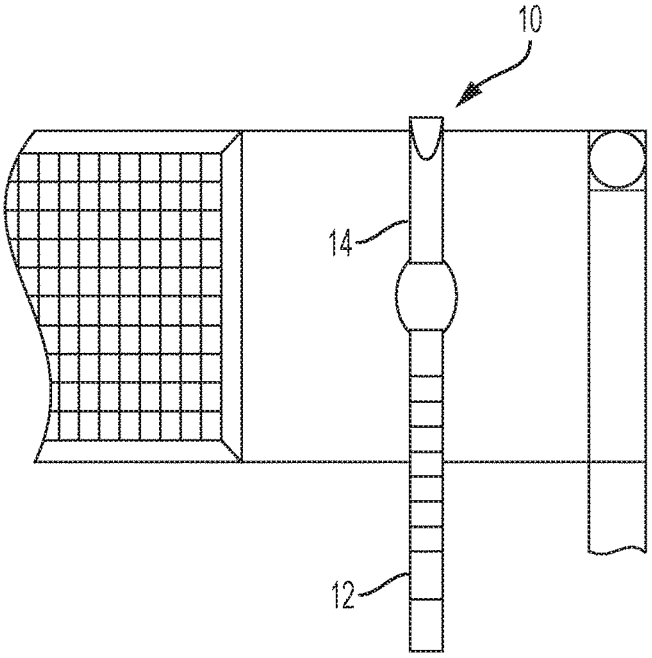
FIG. 9 depicts a front view of the volleyball scorekeeping system of FIG. 1, including the adapter, shown engaged with a standard volleyball net having two supporting ropes or wires.

Referring now to FIG. 1, a perspective view of a volleyball scorekeeping system 10 is shown according to one embodiment. The volleyball scorekeeping system 10 can include a scoring assembly 12 that can be selectively coupled with an adapter 14. The volleyball scorekeeping system 10 can include any suitable scoring assembly 12 and/or adapter 14 such that the volleyball scorekeeping system can be used with any standard or suitable volleyball net. Although volleyball nets vary somewhat in design, the standards adhered to by most leagues and associations are sufficiently similar that the volleyball scorekeeping system can include components, such as the adapter 14, to accommodate all or nearly all volleyball set-ups. Commonly, volleyball nets will be supported by two substantially parallel ropes or wires under tension that are threaded through bottom and top portions of the volleyball net. In such a set-up, the volleyball scorekeeping system can be engaged with the net by coupling the adapter 14 to the uppermost cord as shown in FIG. 9. Another common volleyball net configuration, as shown in FIG. 8, has three substantially parallel cords or wires, where this configuration is similar to that of FIG. 9, but includes one additional supporting wire that generally bisects the volleyball net. In the set-up of FIG. 8, the scoring assembly 12 of the volleyball scorekeeping system 10 can be attached directly to the center cord without use of the adapter 14.

Figure 2:
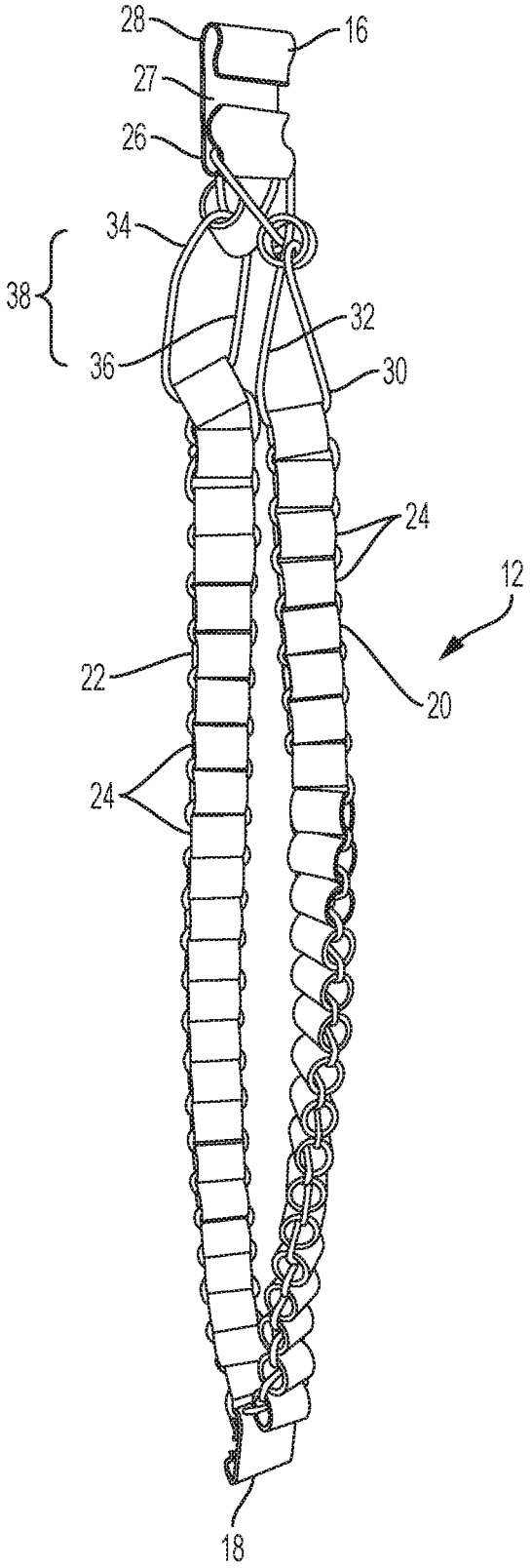
FIG. 2 depicts a perspective view of the scoring assembly shown in FIG. 1.

FIG. 2 depicts a perspective view of the scoring assembly 12 of the volleyball scorekeeping system 10. The scoring assembly 12 can include an upper bracket 16 and a lower bracket 18 that can be coupled together with a first string 20 of scoring elements 24 and a second string 22 of scoring elements 24. The first string 20 and the second string 22 can be coupled to a bottom portion 26 of the upper bracket 16 such that when a top portion 28 of the upper bracket 16 is engaged with a volleyball net support the first string 20 and the second string 22 will hang in a generally downward direction. The first string 20 and the second string 22 can be permanently or detachably coupled to the bottom portion 26 of the upper bracket 16.

Still referring to FIG. 2, the first string 20 can include a first thread 30 and a second thread 32 that can be threaded through, within, or back-and-forth within, a plurality of the scoring elements 24 such that the scoring elements 24 are suspended and substantially retained by the first thread 30 and second thread 32. Similarly, the second string 22 can include a third thread 34 and a fourth thread 36 that can suspend and retain a plurality of scoring elements 24. In one embodiment, the first string 20 and the second string 22 can include an identical number of scoring elements 24, where the total number of scoring elements 24 on each string can be identical to the score needed for a team to win a volleyball game. For example, each string could include 15, 21, or 25 scoring elements 24 depending on the format, but it will be appreciated that any suitable number of scoring elements 24 is contemplated. In the illustrated example, the first string 20 can be associated with the score of a first team and the second string 22 can be associated with the score of a second team.

During use, such as prior to the start of a volleyball match, the scoring assembly 12 can be attached to a standard volleyball net, such as in the manner shown in FIG. 8 or 9. In the initial position, the scoring assembly 12 can be configured such that all of the scoring elements 24 of the first string 20 and the second string 22 and advanced or otherwise retained in the uppermost position adjacent the upper bracket 16. Such a configuration can represent a "zero-zero" score for both teams. When a team scores a point a member of that team can approach the scoring assembly 12, grasp the bottommost scoring element 24 on the string (e.g., string 20 or 22) that represents their team, and urge the bottommost scoring element 24 towards the lower bracket 18. The scoring element adjacent the bottom bracket can represent a point such that the scoring assembly 12 now indicates a score of "One-Zero". The first string 20 and the second string 22 can be sufficiently sized such that a gap or spaced region 38 exists between the scored points and the remaining scoring elements 24. The spaced region 38 can be any size such that it can clearly be seen how many points have been scored by each team. For example, the spaced region 38 can be from about 1 inch to about 5 inches, from about 2 inches to about 4 inches, from about 1.5 inches to about 3.5 inches, or any other suitable dimension.

As play continues, the teams can continue to pull down scoring elements 24 as successive points are scored. If the strings 20, 22 contain the exact number of scoring elements 24 needed to win the game then each team can view both the points scored and the points needed by each team to win the game. The scoring elements 24 can have any suitable configuration, such as hollow cylinders having a width of from about 2 cm to about 4 cm, an outer diameter of from about 2 cm to about 3 cm, and an inner diameter of from about 1.5 cm to about 2.7 cm. The scoring elements 24 can include cylinders of plastic, metal, or the like, and can have any suitable color or design. For example, every five scoring elements 24 can result in a color or design change such that a score can be easily calculated by a player looking at the scoring assembly 12. The scoring elements can also include numbering, lettering, school colors, interchangeable colors, light emitting diodes (LEDs), reflective surfaces, or any other features that can assist in scorekeeping, fun, visibility, identification, or school pride. It will be appreciated that scoring elements 24 in the form of cylinders are described by way of example only where, for example, beads, balls, bobbers, or any other moveable body may be used in place of or in combination with cylinders.

Figure 3:
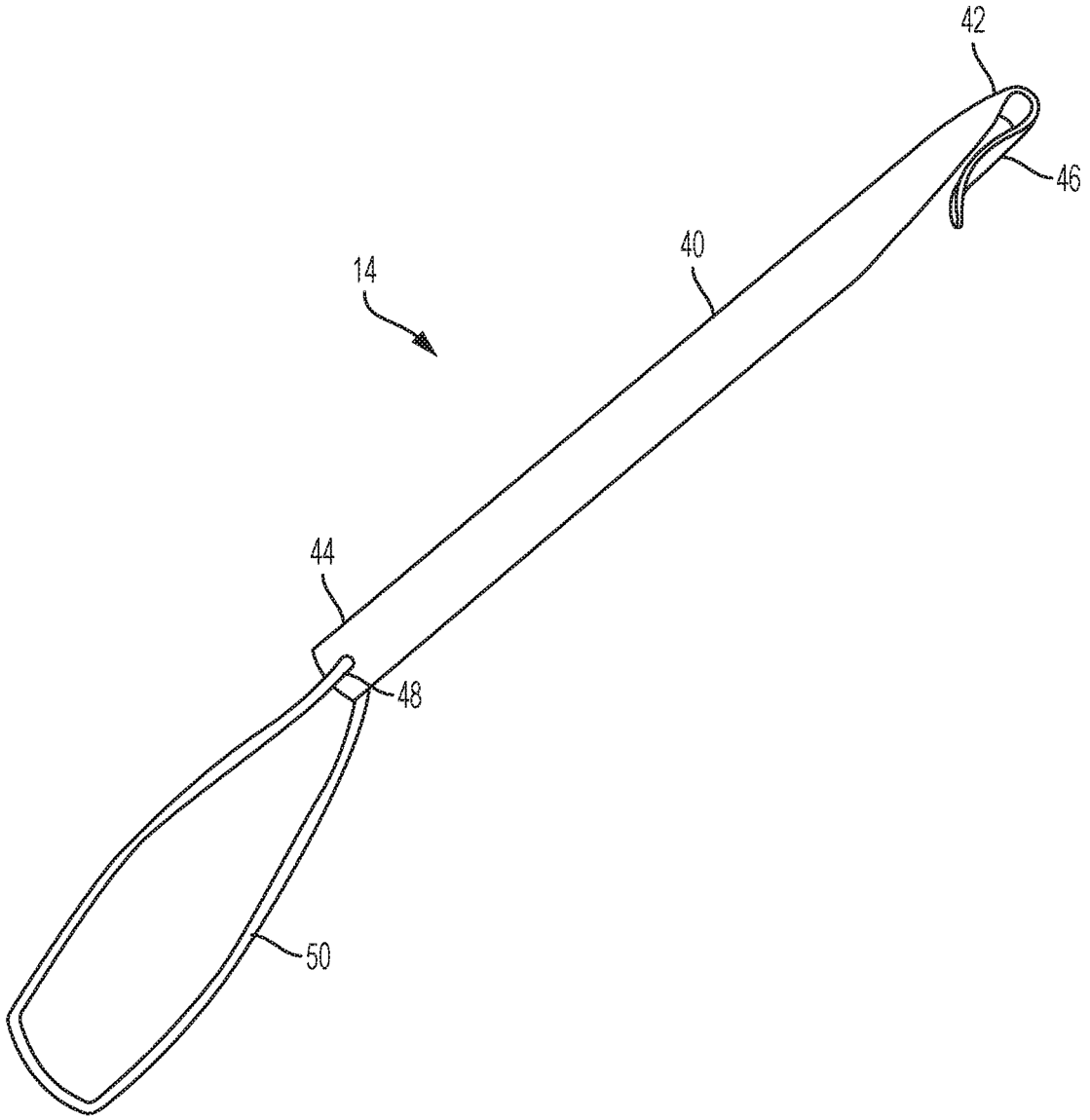
FIG. 3 depicts a perspective view of the adapter shown in FIG. 1.

Referring to FIG. 3, the adapter 14 can be engaged with the scoring assembly 12 to accommodate volleyball nets or set-ups where the scoring assembly 12 alone is not easily attachable or visible. As shown with reference to FIG. 9, the adapter 14 may be particularly useful with volleyball nets that only have an upper and lower tensioning rope, where attachment to the bottom rope is too low and attachment to the top rope puts the scoring assembly 12 out of reach. The adapter 14 can include an elongate cylindrical body 40 having a first end 42 and a second end 44. The first end 42 can include a hook 46 that can be co-molded or integral with the body 40, where the hook 46 can be configured to engage, for example, the top tensioning rope of a volleyball net that only has a two-rope support system. The second end 44 of the adapter 40 can define a through hole 48 through which a loop 50 can be threaded. During use of the adapter 14, after the hook 46 is coupled with a tension rope for a volleyball net, the upper bracket 16 can be coupled with the loop 50 such that the scoring assembly is readily acceptable to players or scorekeepers. It will be appreciated that any suitable adapter is contemplated, where the hook 46 can be any attachment mechanism including a clip, suction cup, tie, or the like. The adapter 14 can also be coupled with the scoring assembly 12 in any suitable manner. For example, the loop 50 can be adjustable such that the height of the volleyball scorekeeping system 10 can be adjusted to a desirable height. The adapter 14 can also include a telescoping body (not shown) to facilitate height adjustment.

Figure 4:
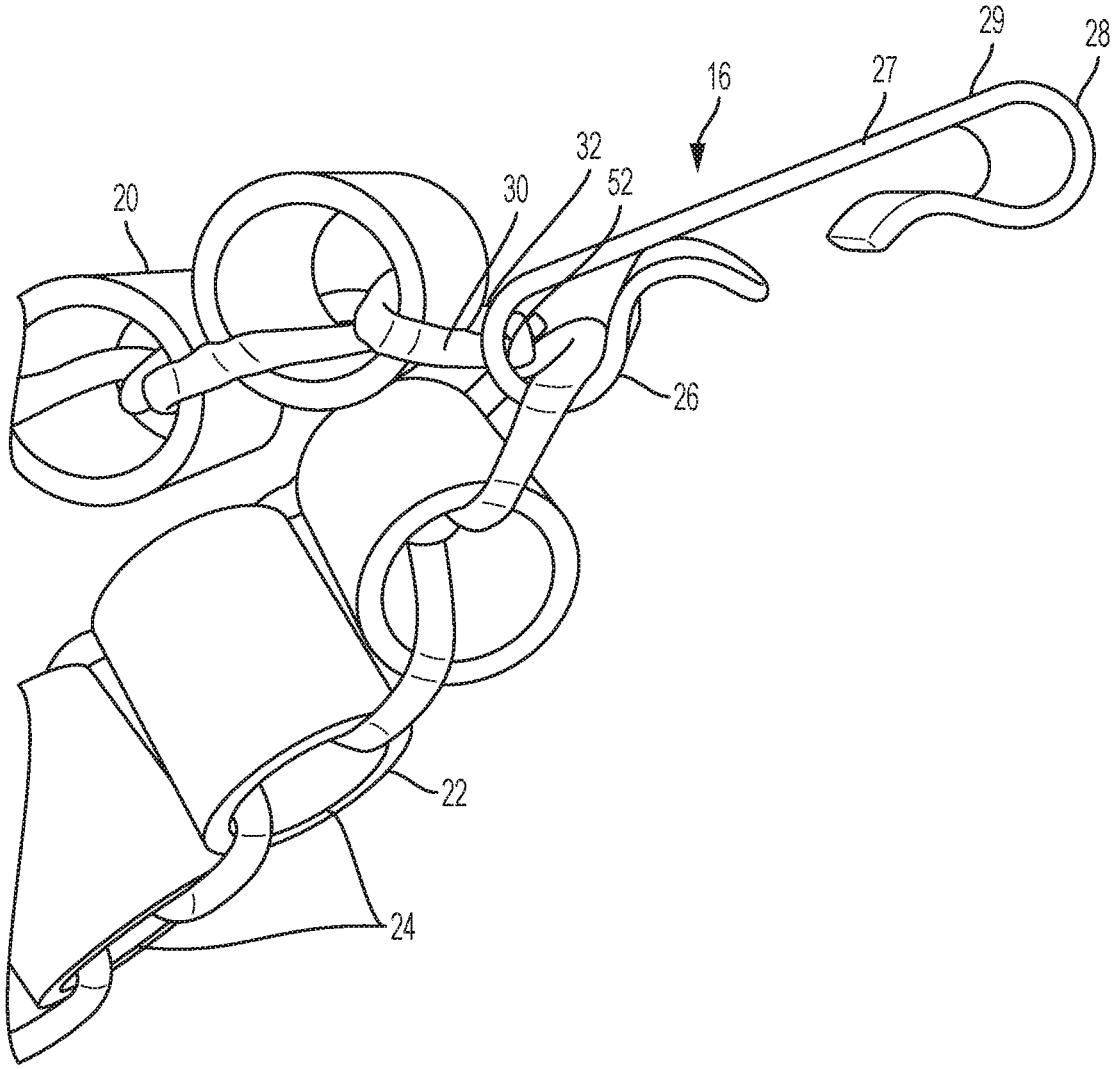
FIG. 4 depicts a perspective view of the top bracket shown in FIG. 1

Referring to FIG. 4, a more detailed view of the upper bracket 16 is shown. In one embodiment the upper portion 28 has a substantially upside down U-shaped configuration such that the upper bracket 16 can be securely connected to a tension line for a volleyball net. The lower portion 26 of the bracket 16 can have a corresponding, but opposite, substantially U-shaped configuration to support the first string 20 and the second string 22. In one embodiment, the lower portion 16 of the upper bracket 16 can define holes 52 through which one or more of the threads 30, 32, 34, 36 can be passed. In one embodiment, threads 30, 32, 34, and 36 are formed from a contiguous piece of thread, line, rope, or other material. For example, threads 30, 32 of the first string 20 can each pass through the holes 52 and can be knotted or otherwise secured to the upper bracket 16. Threads 30, 32 can be coupled to and folded around the lower bracket 18 such that threads 34, 36 are an ascending portion of the same line. In such an example, the threads 34, 36 can be looped over the bottom portion 16 of the upper bracket 16 such that scoring assembly 12 if formed using a single contiguous line. It will be appreciated that threads 30, 32, 34, 36 can be four separate and independently attached lines, can be comprised of two separate lines, or can have any other configuration. It will be appreciated that the threads 30, 32, 34, 36 can be coupled to the upper bracket 16 and/or lower bracket 18 in any suitable fashion including a looped coupling, a tied coupling, a selectively detachable coupling, a fixed coupling, a fused coupling, or the like.

It will be appreciated that the upper bracket 16 and the lower bracket 18 can have any suitable shape or configuration. In the illustrated embodiment, with reference to FIGS. 4 and 5, the upper bracket 16 and lower bracket 18 can be substantially identical in configuration. Each bracket 16, 18 can include a first U-shaped loop or catch and then an opposite U-shaped loop or catch facing the opposite direction. This configuration can allow the scoring assembly 12 to be reversible during use such that the apparatus can easily be reset after the completion of a game. For example, during use two teams may be moving the scoring elements in the direction of the lower bracket 16 and, by the end of the game, most or nearly all of the scoring elements 24 may have been urged in a generally downward direction. At the completion of the game, a player may then push the remaining scoring elements 24 in a downward direction, unhook the upper bracket 16 from the net or adapter 14, reverse the scoring assembly 12, and attach what was the lower portion 54 of the lower bracket 18 to the net or loop 50 of the adapter 50. Once reversed, the lower bracket 18 would take the position of the upper bracket 16 and vice versa. It can be easier to actuate the scoring elements 24 in a downward direction leveraging gravity, so the ability to push the scoring elements 24 downward and to flip the scoring assembly 12 to start a new game may increase the efficiency of the scoring system. Brackets 16, 18 having substantially identical U-shaped portion facing in opposite directions can facilitate the reversible nature of the scoring assembly 12, but it will be appreciated that a number of attachment features are contemplated that could achieve the same objective.

Figure 5:
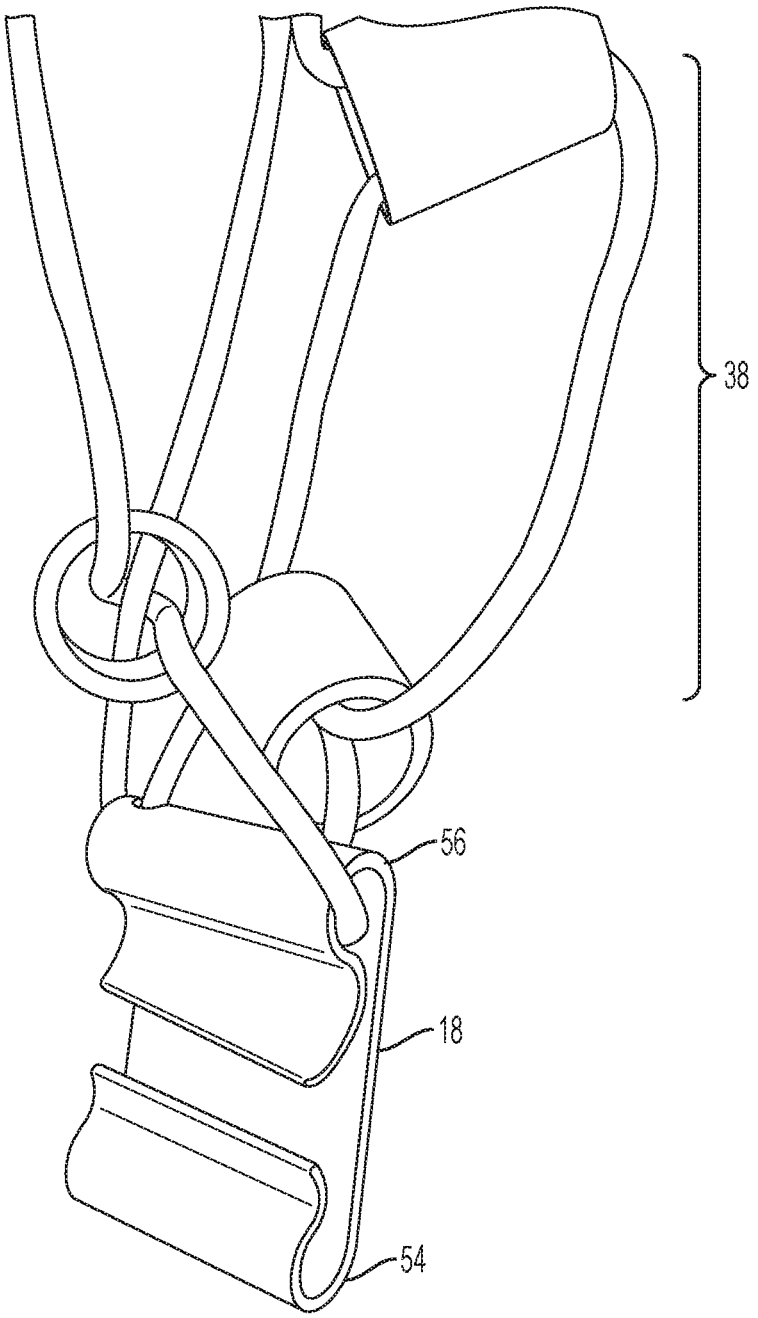
FIG. 5 depicts a perspective view of the bottom bracket shown in FIG. 1.

With reference to FIGS. 4 and 5 the brackets 16, 18 are shown as substantially identical elements with a single unitary structure, but this is not required. The U-shaped portions can have any suitable shape, can include a hinge, can include a living hinge, can include material with memory retention capabilities, can include a gripping surface, or can otherwise be modified. The upper bracket 16 can include a body 27 connecting the upper portion 28 and lower portion 26, where the body 27 can include a surface 29 that can be used to display graphics, a team name, or other desirable information. In one embodiment, the surface 29 can include a digital display, such as an LED or LCD display (not shown), such that the score or other information can be displayed to the players. In one embodiment, the display can show the score combined with a timer indicating time remaining in a game, match, or the like. In an alternate embodiment, the display (not shown) can communicate with remote devices or the like for scorekeeping, spectators, or for other desirable purposes.

Figure 6:
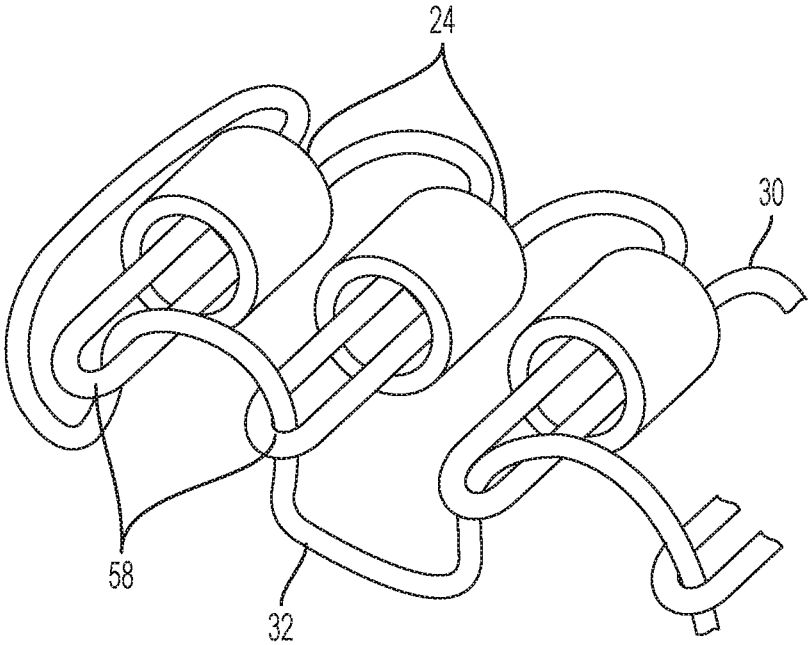
FIG. 6 depicts a partial perspective view of the scoring assembly of FIG. 2 shown in an untensioned state to illustrate one embodiment of a roping configuration.
Figure 7:
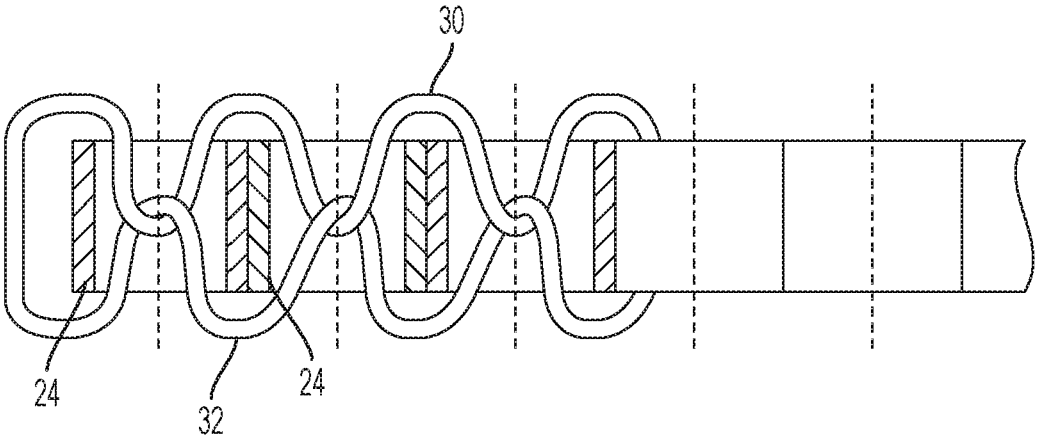
FIG. 7 depicts a top cross-sectional view of the scoring assembly of FIGS. 2 and 6 shown in a tensioned state according to one embodiment.

Referring to FIGS. 6 and 7, it may be advantageous to provide scoring elements 24 in the form of cylinders that are provided with a specific roping arrangement. Simply running a thread through beads or scoring elements can result in the beads or scoring elements having either too high or too low a coefficient of friction such that it can be too difficult to move the scoring elements or the scoring elements will too easily move on their own or in response to incidental contact. As illustrated in FIGS. 6 and 7, it may be advantageous to use a first thread 30 to form a plurality of "eyes" or loops 58 by passing the first thread through the scoring element 24 and forming a loop 58 by passing the thread 30 back through the scoring element 24. The thread 32 can then be threaded or passed through the "eyes" or loops 58 as illustrated in FIG. 6. When the roping configuration shown in FIG. 6 is tensioned for use the scoring elements will be arranged substantially as shown in FIG. 7. A possible advantage in using scoring elements 24 in the form of cylinders with such a roping arrangement is that the cylinder will be biased such that they remain substantially parallel to one another with respect to the central axis of each cylinder. This can be true even as each individual scoring element 24 is adjusted upwardly or downwardly when a point is scored. Such a configuration is aesthetically pleasing, but can also result in a uniform set of compact scoring elements 24 that readily retain a substantially equivalent position with respect to both the first string 20 and second string 22. If the scoring elements 24 became turned or frequently had different positions relative to the threads 30, 32 then it may be more difficult to accurately determine the score. Providing scoring elements that retain a substantially parallel position can provide readily visible evidence of which team is winning, how far one team is behind, etc.

Still referring to FIGS. 6 and 7, the "threaded loop" arrangement illustrated can also provide for a desirable coefficient of friction between the cylindrical scoring elements 24 and the threads 30, 32. Such a configuration may require some force on the part of the user to move each scoring element, but not so much force as to be annoying, difficult, or challenging for younger players. At the same time, the friction may be sufficient to prevent the scoring elements from moving due to gravity, inadvertent contact with a player, or being struck by the ball. Such a configuration may be beneficial in fast paced or high contact games where a robust and accurate scoring system is desirable. With reference to FIGS. 6 and 7, it is contemplated that the first thread 30 and the second thread 32 can be a single contiguous thread, as shown, or can alternatively include one or a plurality of separate threads.

Figure 10:
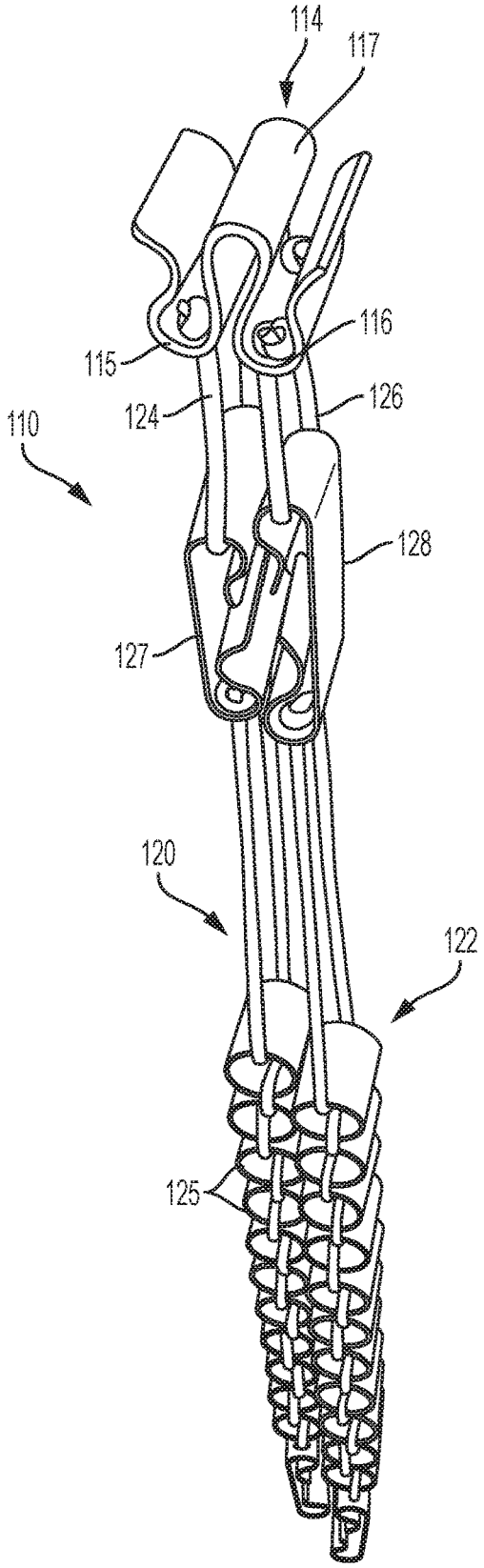
FIG. 10 depicts a front perspective view of one embodiment of a scoring system for sports having a low profile net, where the scoring system includes an adapter and a plurality of beaded strings.

Referring now to FIG. 10, a perspective view of a scorekeeping system 110 is shown according to an alternate embodiment. The scorekeeping system 110 may be particularly useful for tennis, pickleball, or other applications involving a low net that bisects a court. The scorekeeping system 110 can include a first string 120 and a second string 120 that can be selectively coupled with an adapter 114. Commonly, nets for tennis and pickleball will have a height from about 3 to about 3.5 feet and extend for the full width, or beyond the width, of the court. It will be appreciated that systems described herein can be provided or modified for such applications. In the illustrated example, the adapter 114 can have a waveform or W-shaped configuration including a first U-shaped portion 115, a second U-shaped portion 116, and an inverted U-shaped portion 117. The inverted U-shaped portion 117 can be sized to straddle a net, such as a tennis net, to support the scorekeeping assembly 110. The first U-shaped portion 115 can include a first attachment loop 124 and the second U-shaped portion can include a second attachment loop 126. During use, the adapter 114 can be placed over a net such that the first attachment loop 124 is on one side of the net and the second attachment loop is on the opposite side of the net. The inverted U-shaped portion 117 can be sized to engage any suitable net, can include a living hinge to grip the net when engaged, or can include a hinged clip to engage the net.

Figure 11:
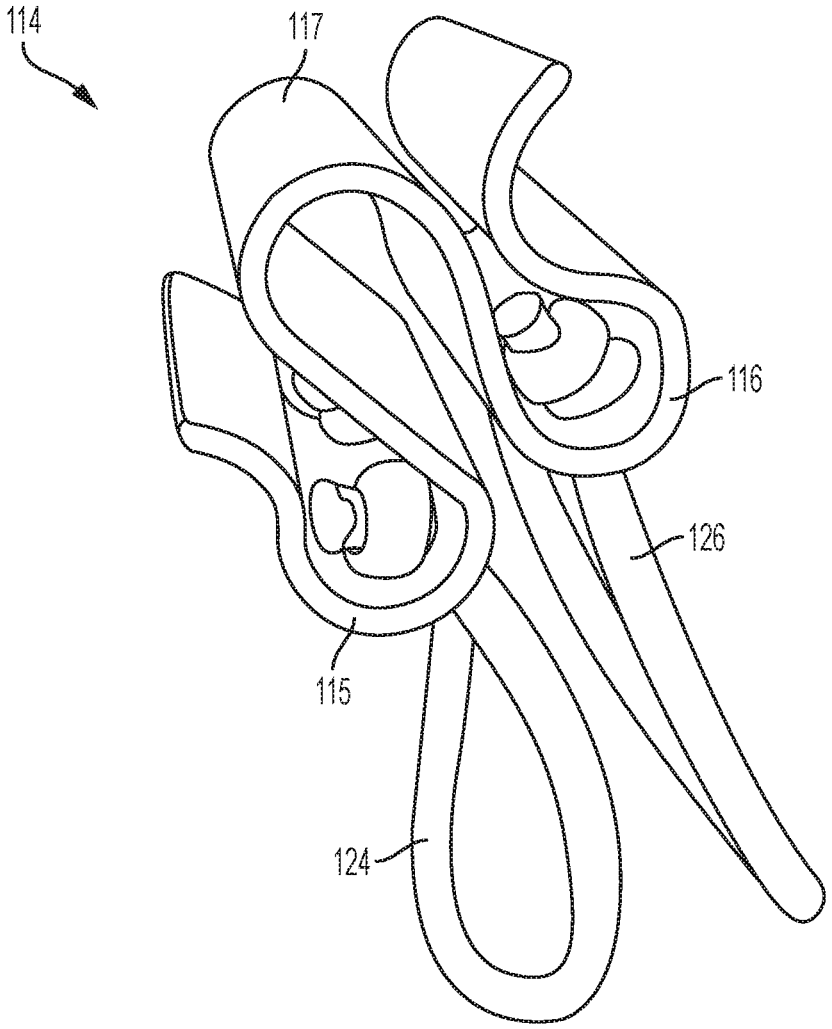
FIG. 11 a front perspective view of the adapter shown in FIG. 10.

When the adapter 114 is engaged with a net the first string 120 can be coupled to the first attachment loop 124 and the second string 122 can be coupled with the second attachment loop 126. In this way, each player or team in a match can have a scoring system on their side of the net. Each of the strings 122, 124 can include a plurality of scoring elements 125 as described herein. The first string 120 can include a first bracket 127 and the second string 122 can include a second bracket 128 to selectively engage the attachment loops 124, 125. As described herein, after a game or match is completed the strings 120, 122 can be reversed such that the scoring elements 125 can easily be reset for a new game. FIG. 11 illustrates a front view of the adapter 114 according to one embodiment.

Figure 12:
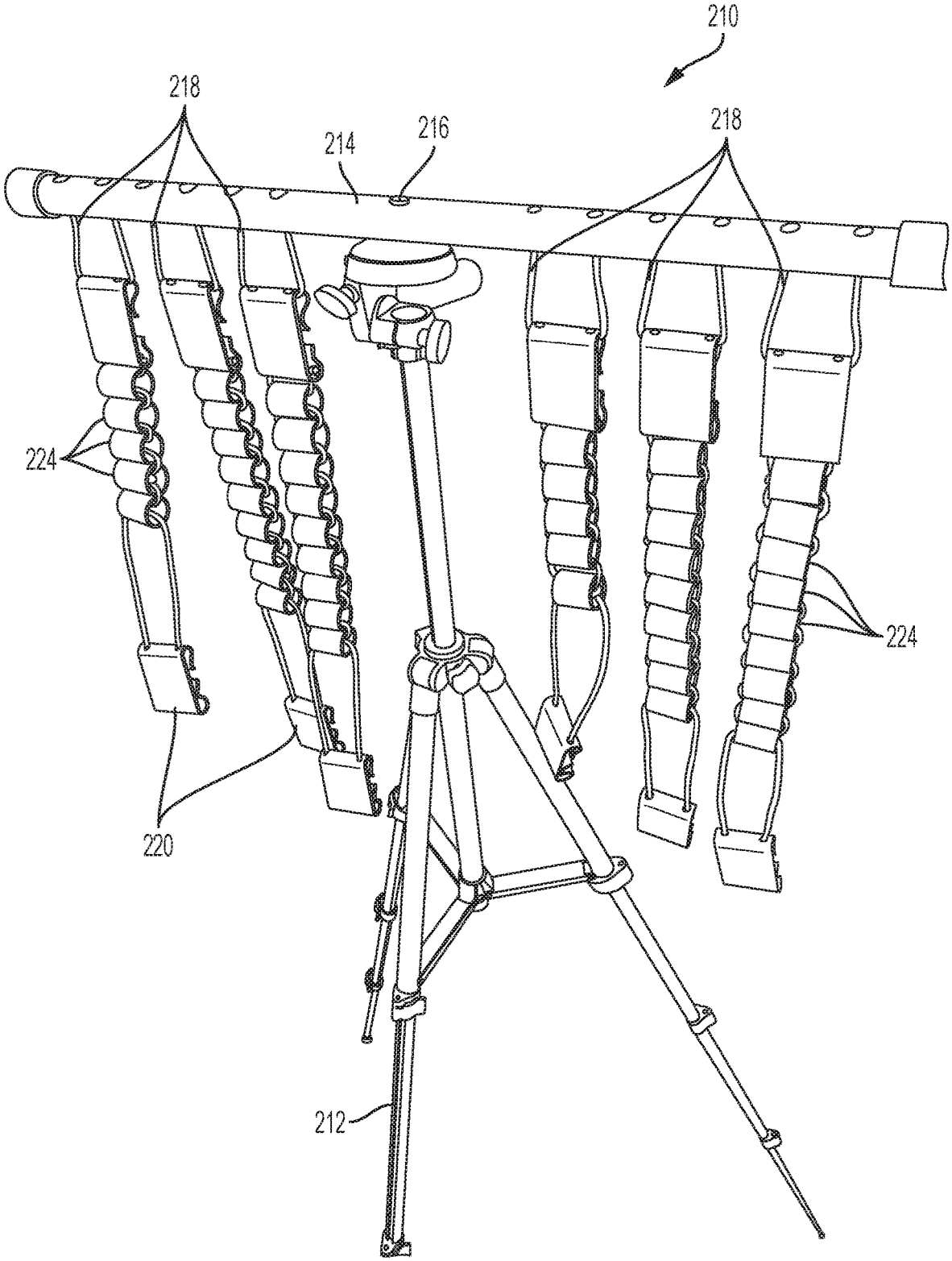
FIG. 12 depicts a front perspective view of a scoring system according to an alternate embodiment.

FIG. 12 illustrates an alternate embodiment of a scorekeeping system 210 that can be used in a variety of sports. The scorekeeping system 210 can include a tripod or base 212 that support a substantially horizontal crossbar 214. The crossbar 214 can be selectively detachable from the base 212 with a fastener 216, such as a threaded bolt. The crossbar 214 can include a plurality of fixed loops 218 that can function as attachment points for a plurality of reversible strings 220. As illustrated, any suitable number of strings 220 can be provided including strings having a varying number of scoring elements 224. Such a configuration may be useful in sports such as tennis where multiple sets are often played and scoring rules can vary depending upon which set is being played. Providing a crossbar 214 with a plurality of loops 218 can provide flexibility to the scorekeeping system 210, where different strings 220 can be attached depending on the needs for a particular application. This modular aspect of the scorekeeping system may facilitate the system being packaged as a kit or in user-selectable pieces.

Figure 13:
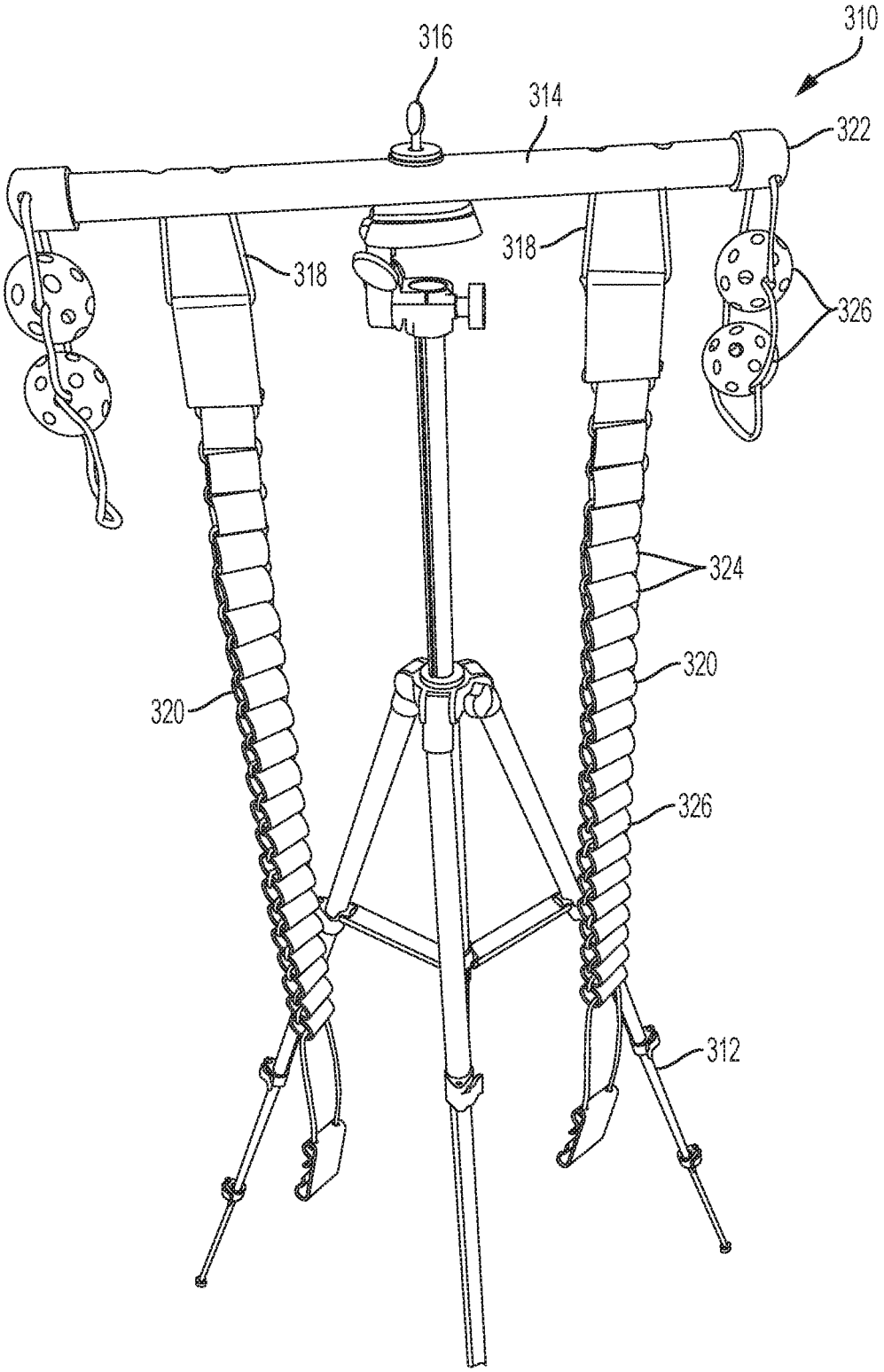
FIG. 13 depicts a front perspective view of a scoring system according to an alternate embodiment.

FIG. 13 illustrates an alternate embodiment of a scorekeeping system 310 that can be used in a variety of sports. The scorekeeping system 310 can include a tripod or base 312 that support a substantially horizontal crossbar 314. The crossbar 314 can be selectively detachable from the base 312 with a fastener 316, such as a threaded bolt. The crossbar 314 can include a plurality of fixed loops 318 that can function as attachment points for a plurality of reversible strings 320 having scoring elements 324. The scorekeeping system 310 can include endcap assemblies 322 that can be used to indicate a different aspect of the score or match than what is being measured with the scoring elements 324. For example, the endcap assemblies 322 can include scoring elements 326 that can be of a different shape, size, color, or the like, to indicate a different scoring element of a game or match. In tennis, the endcap assemblies 322 can be used to indicate how many sets a player has won, the rank of a player, if the score is "add in" or "add out", or the like. It will be appreciated that the configuration of the endcap assemblies 322 can vary depending upon the sport or version of the sport that is being played. In one embodiment, the endcap assemblies 322 are selectively removable from the crossbar 314 to facilitate a modular scorekeeping system. For example, the crossbar 314 can be used without endcap assemblies 322, or a user could select from a variety of available options of endcap assemblies for use in different applications. A kit could include one or a plurality of such endcap assemblies 322 for use or selective attachment.

Figure 14:
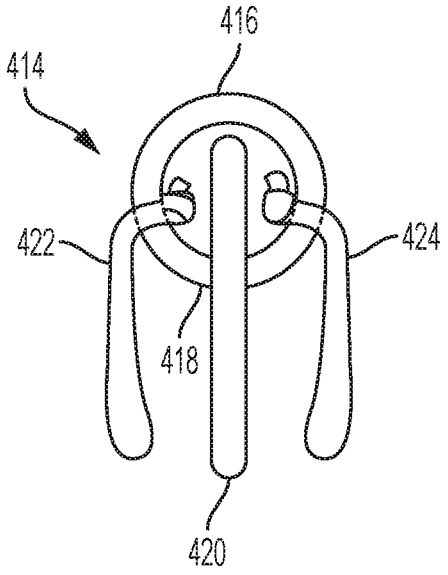
FIG. 14 depicts a side view of an adapter according to an alternate embodiment, the adapter being shown positioned over a low profile net.
Figure 15:
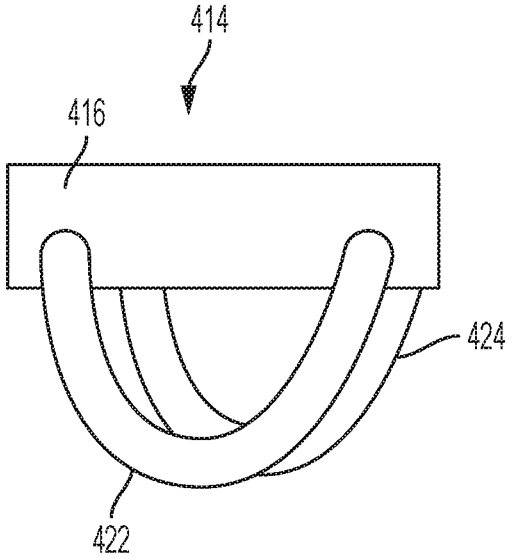
FIG. 15 depicts a front view of the adapter shown in FIG. 14.

FIGS. 14 and 15 illustrate an alternate version of an adapter 414 that can be used for sports or applications involving a low profile net. The adapter 414 can include a cylindrical body 416 defining a channel 418, where the adapter 414 can be placed over a net 420 such that the net 420 is retained by the cylindrical body 416. A first attachment loop 422 and a second attachment loop 424 can be fixedly coupled with the cylindrical body 416. Such an adapter may be easily transported or included as part of a kit to modify a net for scorekeeping purposes.

Figure 16:
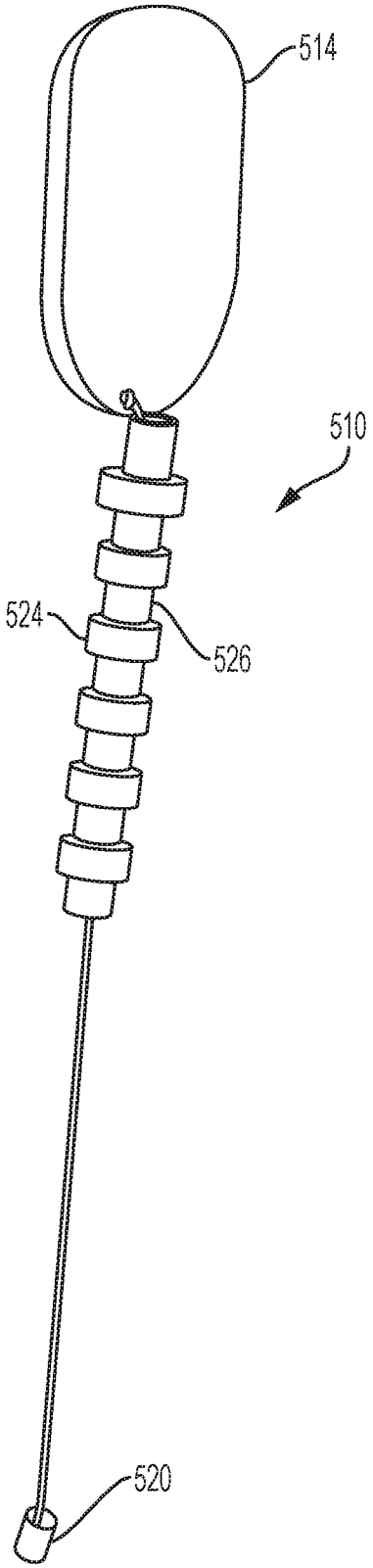
FIG. 16 depicts a front perspective view of a scoring system according to an alternate embodiment.

Referring now to FIG. 16, a perspective view of a scorekeeping system 510 is shown according to an alternate embodiment. The scorekeeping system 510 may be particularly useful for racquetball, squash, or other applications where a net is not present, but the players have access to a wall. The scorekeeping system 510 can include a string 520 that can be selectively coupled with an adapter 514. In the illustrated embodiment, the adapter 514 can be a suction cup that can be selectively attached to a wall or other surface in or near the field of play. The string 520 can include a plurality of scoring elements 524 that can be relatively lightweight balls of material, soft beads, hollow plastic balls or beads, or any other suitable indicator that has relatively low mass. The scoring elements 524 may be relatively light such that the adapter 514 is able to securely attach the string 520 to wall without falling off. In such embodiments, the scoring elements 520 may be amorphous such that they are difficult to differentiate, where spacers 526 may be provided to create space between the scoring elements 524. In one embodiment, multiple scorekeeping systems 510 could be used in a single match, such as where a single string could be used by each individual player, or alternatively the adapter 514 could hold or retain a plurality of strings.

Figure 17A:
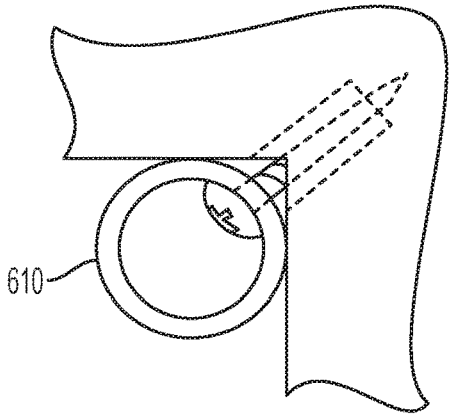
FIGS. 17A-17C depict a plurality of embodiments of attachment features for a wall or corner.
Figure 17B:
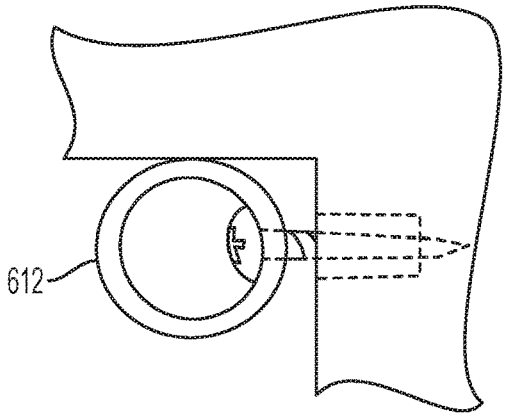
Figure 17C:
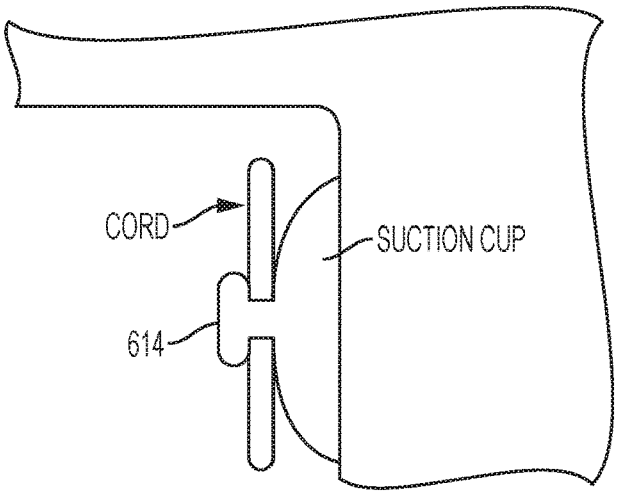

Referring to FIGS. 17A-C, it will be appreciated that scoring systems described herein can be used with any suitable fixture or attachment to a court, field, wall, corner, or the like. For example, a fastener 610 with an attachment loop can be secured into the corner of a wall. A fastener 612 with an attachment loop can be screwed into the side of a wall. A fastener 614 in the form of a suction cut can be attached to any suitable surface, such as a substantially planar wall. The fasteners 610, 612, 614 can include any suitable feature, such as attachment loops or the like, for strings having scoring elements as described herein.

Figure 18:
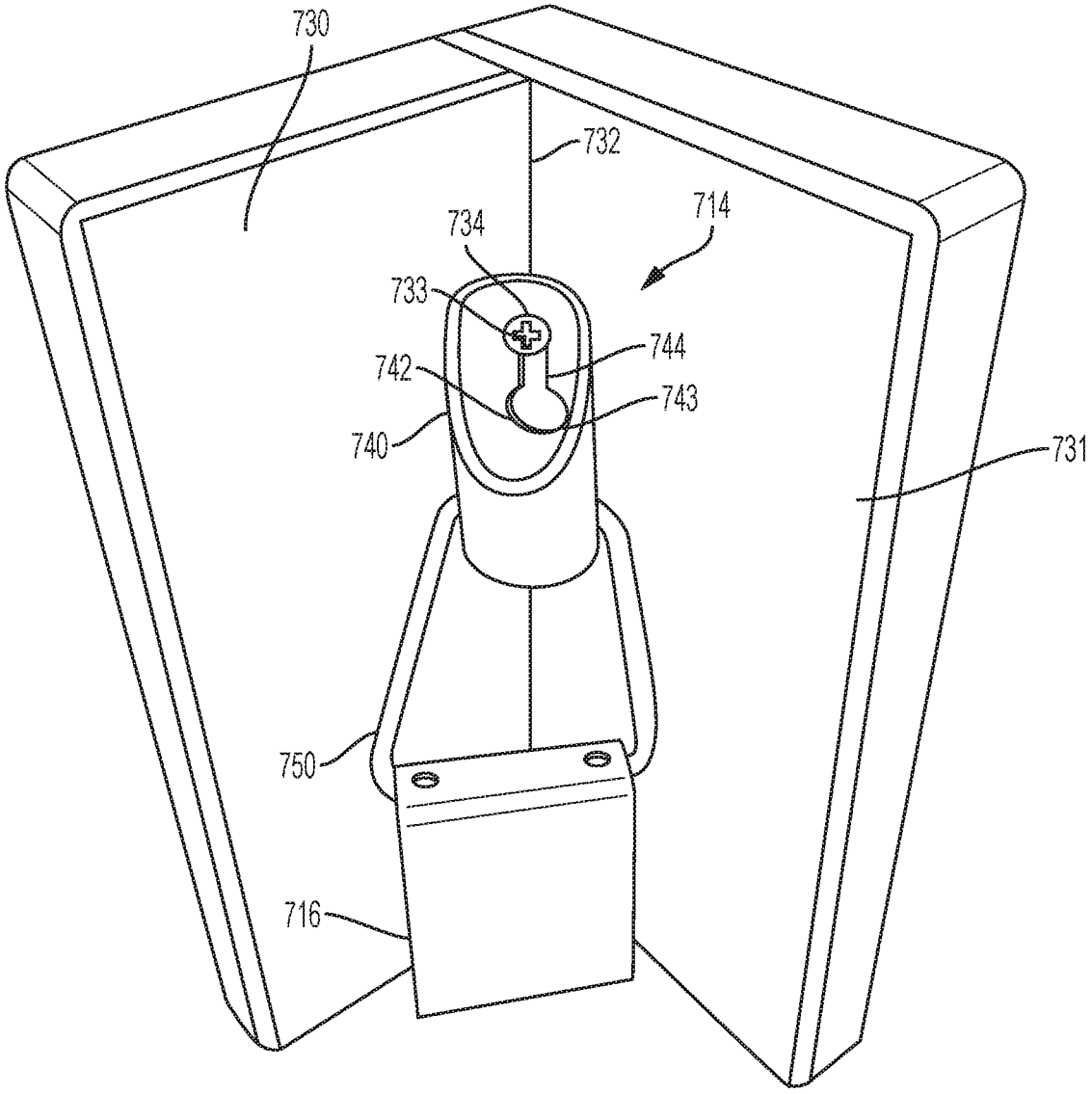
FIG. 18 depicts a front perspective view of an adapter according to an alternate embodiment, where the adapter is shown engaged with the corner of a wall.

Referring to FIG. 18, an alternate embodiment of an adapter 714 is shown for use with one or a plurality of strings (not shown). The adapter 714 can be useful for walled environments, such as squash courts, where a net is not available for hanging a scoring system. It may also be advantageous to provide a scoring system that can be more securely attached to a surface than might be feasible with a suction cup. In use, a first wall 730 can meet a second wall 731 at a corner 732. A screw 733 or other fastener having a head 734 can be coupled with the corner 732. The adapter 714 can have a fastening element 740 that can define an aperture 742, where the aperture 742 can include a first aperture portion 743 and a second aperture portion 744. The first aperture portion 743 can be sized such that it is larger than the head 734 of the screw 733. The second aperture portion 744 can be sized such that it is smaller than the head of the screw, but large enough to accommodate the shaft (not shown) of the screw 743. During installation, the first aperture portion 743 of the fastening element 740 can be placed over the screw 733 and can then be urged downward such that the second aperture portion 744 engages the shaft (not shown) of the screw 733. When installed, as illustrated, the fastening element can be secured between the corner 732 and the head 734 of the screw 733. Such an embodiment can allow for the screw 733 to be selectively attached to the corner 732 and the fastening element can be selectively attached to the screw. The adapter 714 can also include a fastening loop 750 that can be fixedly or detachably coupled to a bracket 716 that can be used to attach one or a plurality of strings (not shown).

It will be appreciated that the adapter 714 can be attached to the first wall 730 or second wall 731 and need not be placed in the corner 732. The adapter can be fixedly coupled with the screw 733 or other fastener, where the screw can be fixedly retained by the fastening element, but still rotatable such that it can threadedly engage a wall or corner. The fastening element 740 of the adapter can be cylindrical to accommodate a number of geometries, can be a bracket having a 90 degree angle to accommodate corners, or can have any other configuration.

It will be appreciated that the scoring systems described herein can be used with any sport such as, for example, net sports including wallyball, tennis, badminton, pickleball, or the like. The same scoring system can be used for each sport or, in the alternative, each sport can have a dedicated type of scoring assembly that matches the height, score, and other features of each individual game. For example, in pickleball or tennis, where a relatively low net is used, an adapter that straddles the net and has loops on opposite sides of the net for attachment of a string, such as first string 20 and second string 22, could be incorporated. The scoring system can also be used in sports that do not have a net, but do have accessible walls, such as racquetball, squash, or the like. The assembly can include a suction cup or other attachment element, including a screw or the like that can be bored into the corner of the court, to facilitate scorekeeping in such an environment. There is no limit to the type of activity with which the scoring assembly can be used where, for example, buoyant bobbers could be used in a floating assembly for use in swimming lap counting or water polo. For suction cup applications, in particular, it may be advantageous to provide very light beads or scoring elements, such as elements made from fuzzy and/or bright fabric, that can display a score without adding significant weight to the system.

It will be appreciated that the scoring system can be sold as a kit and/or modular system for use with a wide variety of sports, scoring arrangements, or the like. For example, the scoring system can include a crossbar having one or a plurality of loops or attachment points that can be used to selectively attach strings having a variety of scoring elements, number of scoring elements, etc. The crossbar itself can be telescoping, can come in attachable sections, or otherwise can be modified by the user for use with a particular sport. For example, in tennis, a 3 set match could include a crossbar selectively mounted to tri-pod that can be positioned near the net. The crossbar can have telescoping or attached segments such that there are three attachment loops or features on each side of the net. A string can then be hooked to each loop as each new set starts to show the score for each set. Each string could have, for example, seven scoring elements to indicate the number of games needed to win the set. The strings representing completed sets could be left attached so that spectators can easily see past scores and the progress of the match. The ends of the cross bar can include detachable caps that can include a distinct or differing set of scoring elements, such as larger scoring elements, that can be used to display another scoring features such as sets won, etc. In the tennis example, the selectively detachable strings could show set scores, where the end caps could contain two moveable elements that indicate the number of sets the player has already won. Any suitable arrangement is contemplated where key components for a variety of sports could be provided as a kit with a single unit. Such a kit could be kept in the trunk of a car, or the like, for easy use with a variety of sporting events.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A scorekeeping system, the system comprising:

a. a plurality of scoring elements, each of the plurality of scoring elements comprising a hollow cylinder having a first open end and a second open end;

b. an upper bracket to which are removably secured a first string having a first portion of the plurality of scoring elements and a second string having a second portion of the plurality of scoring elements;

c. lower bracket to which are removably secured the first string and the second string, wherein, when the first string and the second string are removed from the lower bracket, the first portion of the plurality of scoring elements remains secured on the first string and the second portion of the plurality of scoring elements remains secured on the second string;

d. the first string having a first thread and a second thread, the first thread being inserted through each of the first portion of the plurality of the scoring elements, the first thread defining a plurality of first loops disposed external to each of the first portion of the plurality of scoring elements, the second thread being inserted through the plurality of first loops;

e. the second string having a third thread and a fourth thread, the third thread being inserted through each of the second portion of the plurality of the scoring elements, the third thread defining a plurality of second loops disposed external to each of the second portion of the plurality of scoring elements, the fourth thread being inserted through the plurality of second loops; and wherein, when the first string and the second string are removed from the upper bracket, the first portion of the plurality of scoring elements remains secured on the first string and the second portion of the plurality of scoring elements remains secured on the second string.

2. The scorekeeping system of claim 1, wherein the first portion of the plurality of the scoring elements includes the same number of the plurality of scoring elements as the second portion of the plurality of the scoring elements.

3. The scorekeeping system of claim 1, wherein the number of the first plurality of scorekeeping elements is equal to the score needed to win a game for which a score is being kept.

4. The scorekeeping system of claim 1, wherein the first string of the plurality of scoring elements is associated with a first team in a game for which the score is being kept and the second string of the scoring elements is associated with a second team in the game.

5. The scorekeeping system of claim 1, wherein the upper bracket is adapted to hang from a net used in a game selected from the group consisting of volleyball, tennis, and badminton, and wherein the first string and the second string hang downward from the net.

6. The scorekeeping system of claim 1, wherein each of the first portion of the plurality of scoring elements and each of the second portion of the plurality of scoring elements comprise at least two groups of the scoring elements, each of the groups having a distinctly different color with respect to the other.

7. The scorekeeping system of claim 1, wherein the scorekeeping system is configured such that the first portion of the plurality scoring elements remains secured on the first string and the second portion of the plurality of scoring elements remains secured on second string unless the first string and the second string are severed.

8. The scorekeeping system of claim 1, wherein the upper bracket or the lower bracket is configured to be removably secured to a net suspended across a game court.

9. A method of keeping track of points in a game selected from the group consisting of volleyball, tennis, and badminton using the scorekeeping system of claim 1, the method comprising:

securing the upper bracket to a net suspended across a game court;

securing the first string and the second string to the upper bracket;

moving one of the first portion of the plurality of scoring elements along the first string when a first team scores one of the points;

moving one of the second portion of the plurality of scoring elements along the second string when a second team scores one of the points.

10. The method of claim 9, wherein the scorekeeping system of claim 1 further comprises a lower bracket to which are removably secured the first string and the second string, the method further comprising:

when a first round of the game is complete, removing the upper bracket from the net; and securing the lower bracket to the net to track points in a second round of the game.

* * * * *